United States Patent [19]

Lentz

[11] Patent Number: 4,514,600

[45] Date of Patent: Apr. 30, 1985

[54] VIDEO GAME HAND CONTROLLER

[75] Inventor: James M. Lentz, Knoxville, Tenn.

[73] Assignee: North American Philips Corporation, New York, N.Y.

[21] Appl. No.: 551,225

[22] Filed: Nov. 14, 1983

[51] Int. Cl.[3] ..... H01H 9/00; H01H 25/00

[52] U.S. Cl. ..... 200/5 R; 200/6 A; 200/17 R; 200/153 K; 200/276

[58] Field of Search ..... 200/5 R, 5 A, 6 R, 6 A, 200/7, 17 R, 153 K, 67 DB, 275, 276

[56] References Cited

U.S. PATENT DOCUMENTS

| | | | |
|---|---|---|---|
| 2,923,787 | 2/1980 | Nelson | 200/67 DB |
| 3,290,455 | 12/1966 | Christensen | 200/6 A |
| 3,699,296 | 10/1972 | Harris | 200/67 DB |
| 4,297,542 | 10/1981 | Shumway | 200/5 A X |
| 4,349,708 | 9/1982 | Asher | 200/6 A |
| 4,375,631 | 3/1983 | Goldberg | 338/128 |
| 4,394,548 | 7/1983 | Dola | 200/5 R X |
| 4,406,931 | 9/1983 | Dola | 200/6 A |
| 4,434,412 | 2/1984 | Ruumpol | 336/134 |

FOREIGN PATENT DOCUMENTS

| | | | |
|---|---|---|---|
| 2004126 | 3/1979 | United Kingdom | 200/67 DB |

*Primary Examiner*—J. R. Scott

*Attorney, Agent, or Firm*—Thomas A. Briody; William J. Streeter

[57] ABSTRACT

A hand controller for use with a home electronic video game produces electrical control signals in response to manipulation of a control stick extending through an aperture in the controller housing. The control stick is attached to an actuator stem which forms part of a multi-position switch assembly within the housing. The switch assembly includes a helical coil spring which is attached at one end to an interior surface of the housing and is arranged to concentrically receive the actuator stem so as to support the actuator stem and control stick in an upright non-actuated position. Displacement of the control stick and actuator stem causes the helical spring to contact one or more of a plurality of electrical contact pads disposed generally concentrically around the spring. This causes appropriate control signal to be produced for application to the video game. The contact pads are shaped and positioned to create favored positions for the control stick which enhance the sense of control provided by the controller.

9 Claims, 5 Drawing Figures

VIDEO GAME HAND CONTROLLER

BACKGROUND OF THE INVENTION

The present invention relates generally to electrical switches, and more particularly to hand-held controls for controlling the actions of game characters in electronic video games.

An electronic video game unit of the type intended for home use with standard television receivers is typically provided with one or more hand-held controllers each connected to the unit by means of a flexible electrical cable. These controllers typically control the actions and movements of game characters or other elements displayed on the television screen by the game unit. In their usual form, the hand controllers are each provided with a displaceable vertically extending control stick which the user displaces in the direction he wishes the game character to travel. Another user actuable control, usually in the form of a push button switch mounted near the control stick, controls momentary actions such as the launching of projectiles by the game characters.

As the hand controller is the link by which the user interacts with the electronic video game unit, it is important that the controllers allow the player to easily and naturally direct the actions of the displayed game characters. To this end, hand controllers are preferably of a size and weight compatible with comfortable hand-held use. More particularly, the projecting control stick should be dimensioned and positioned in a manner allowing it to be naturally and comfortably manipulated by the game player.

A frequent complaint directed toward existing hand controllers is that the direction of movement of a displayed game character does not accurately follow that of the control stick. Precision of control is therefore another desirable feature of video game hand controls. One way of achieving such precision is to provide the control stick with a tendency to favor displacement along discrete paths of movement, each path corresponding to a unique direction of movement of a game character. A control so provided allows the movement of the video game character to be accurately determined.

A further requirement of hand controllers is that they be rugged in construction so as to provide reliable operation during prolonged periods of emotionally stimulating play. Furthermore, the construction must lend itself to economical manufacture using conventional manufacturing techniques without sacrificing quality and reliability.

In accordance with the present invention, a video game hand controller incorporating the above-noted desirable features is provided. A vertically mounted coil spring, together with an actuator stem concentrically located therein, is provided in supportive engagement to the control stick. The lower end of the spring is affixed to an interior surface of the control housing. As the control stick is displaced, the spring is brought into contact with one or two of a plurality of electrical contacts disposed generally around the periphery of the spring. The electrical contacts may be located and shaped to provide a plurality of preferred locations to which the spring naturally tends to move, thereby providing precise control of game character movement. As the spring and the electrical contacts are each fashioned from relatively heavy and durable metal, a highly reliable and durable control switch is provided.

SUMMARY OF THE INVENTION

A hand operable controller for use with home electronic video game units and the like produces a control signal in response to user manipulation of an actuator stem. A generally elongated, electrically conductive, deformable switch contact member is affixed at one end to an interior surface of the hand control housing. An actuator stem angularly displaceable from the exterior of the housing is concentrically received within the switch contact member. A plurality of electrically conductive contact pads are concentrically disposed around the switch contact member and spaced apart from both the switch contact member and from each other. Upon angular displacement of the actuator stem the switch contact member is caused to contact one or more of the contact pads, depending on the radial direction of the displacement. Such contact provides electrical continuity between the contact pad and the switch contact member to produce the desired electrical control signals.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, and the several figures in which like reference numerals identify like elements, and of which:

DESCRIPTION OF THE PREFERRED EMBODIMENT

Figure 1:
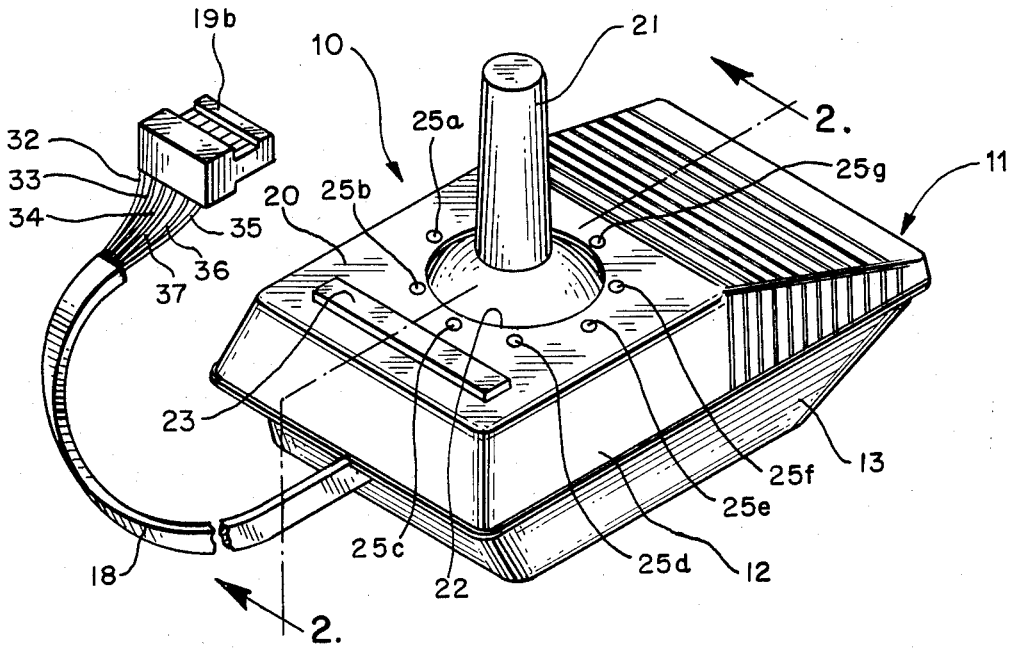
FIG. 1 is a perspective view of a video game hand controller constructed in accordance with the present invention.
Figure 5:
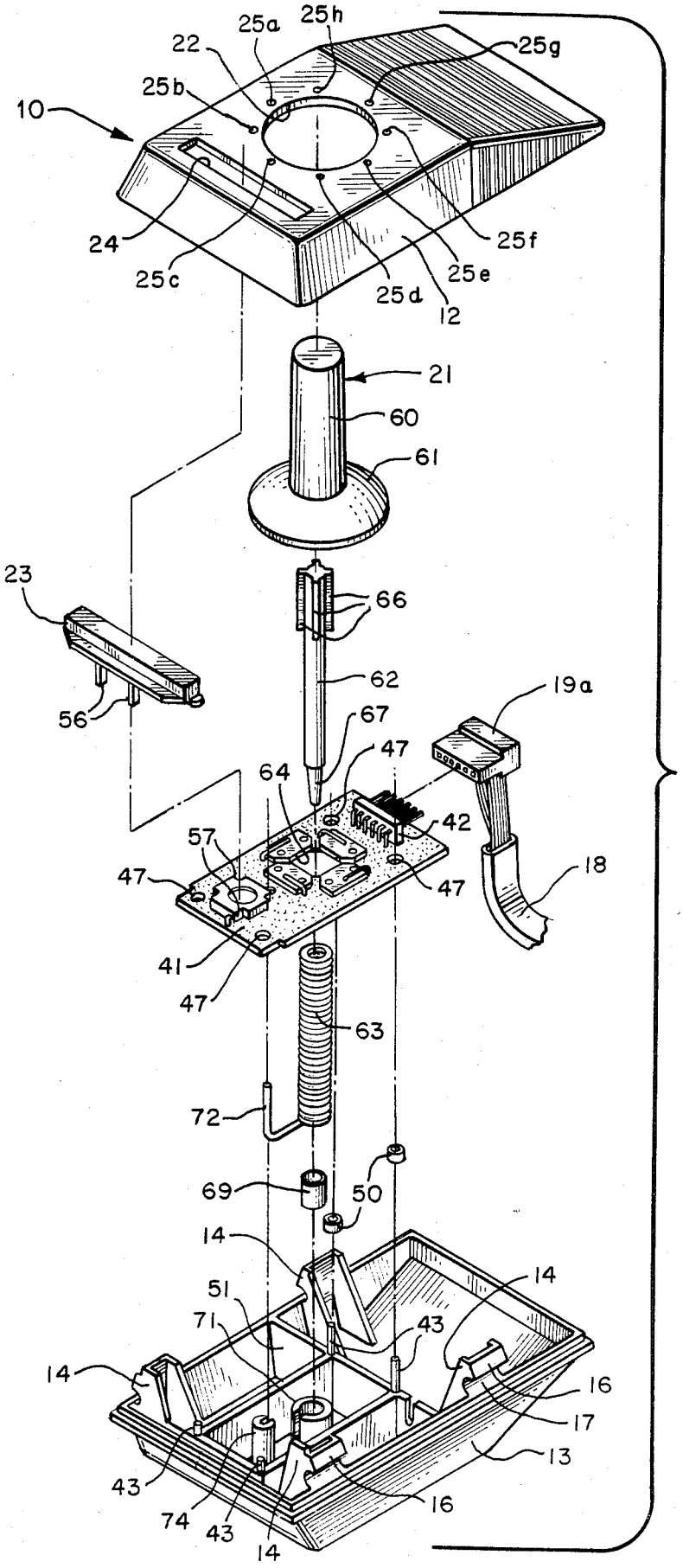
FIG. 5 is an exploded perspective view of the video game hand controller illustrated in FIG. 1.

Referring to the figures, and particularly to FIGS. 1 and 5, a video game hand controller constructed in accordance with the present invention is indicated generally by reference numeral 10. The hand controller includes an elongated generally rectangular housing 11 dimensioned to fit comfortably within the hand. As shown, the housing comprises upper and lower members 12 and 13, each of which may be fashioned from a molded high-impact plastic or similar material. Four integrally formed tab portions 14 (FIG. 5), each having a beveled outer face 16, project upwardly from lower housing member 13 and include a generally horizontal locking recess 17. Four integrally formed arcuate ridges (not shown) provided along the lower interior side edges of upper housing member 12, are so located and dimensioned as to engage recesses 17 when upper housing member 12 is pressed onto lower housing member 13.

The video game hand controller 10 provides an electrical output in response to user manipulation of the control and accordingly, means for electrically interconnecting the controller with a video game unit (not shown) are provided in the form of a multi-conductor cable 18. The cable includes a connector 19*a* within the controller housing, and extends through an aperture provided in lower housing member 13 and terminates in connector 19*b* (FIG. 1), which connects with a complementary connector (not shown) in the video game unit.

In order to control the actions of the video game characters, the video game hand controller 10 includes two user-actuable controls; a direction switch in the form of an upwardly angularly-displaceable projecting stick-shaped control stick 21 extending through an aperture 22 in the upper horizontal surface 20 of upper housing member 12, and a downwardly-displaceable event switch in the form of actuator bar 23 extending through an aperture 24 transversely across the forward portion of upper housing member 12, as shown in FIG. 1.

In use, control stick 21 may be angularly displaced with respect to the upper horizontal surface 20 of housing 11 in any desired radial direction around its axis. Typically, such angular displacement will result in a corresponding change in the direction of motion of displayed video game characters. In the embodiment shown in FIGS. 1 and 5, video game characters may move in one of eight directions corresponding to displacement of the control stick toward a corresponding one of eight direction markers 25 integrally formed on surface 20. Actuator bar 23 is typically used to control such game character actions as the launching of projectiles at opposing game characters in response to downward motion of the actuator bar. In using the controller, most users will support the controller in one hand, while manipulating the control stick 21 with the other. Since in grasping the controller the thumb of the supporting hand tends naturally to overlie the actuator bar, it is common for most video game users to rely on the overlying thumb to depress the bar. Because the actuator bar extends substantially fully across the upper surface of the control housing, it can be actuated with equal ease by right or left-handed users.

In the embodiment described, multi-conductor cable 18 includes six individual conductors 32–37. The video game hand control produces a predetermined electrical output response by establishing electrical continuity between a common conductor, conductor 32, and various combinations of conductors 33–36 in response to the direction of displacement of control stick 21. Downward displacement of switch bar 23 results in establishing continuity between conductor 32 and conductor 37.

Figure 2:
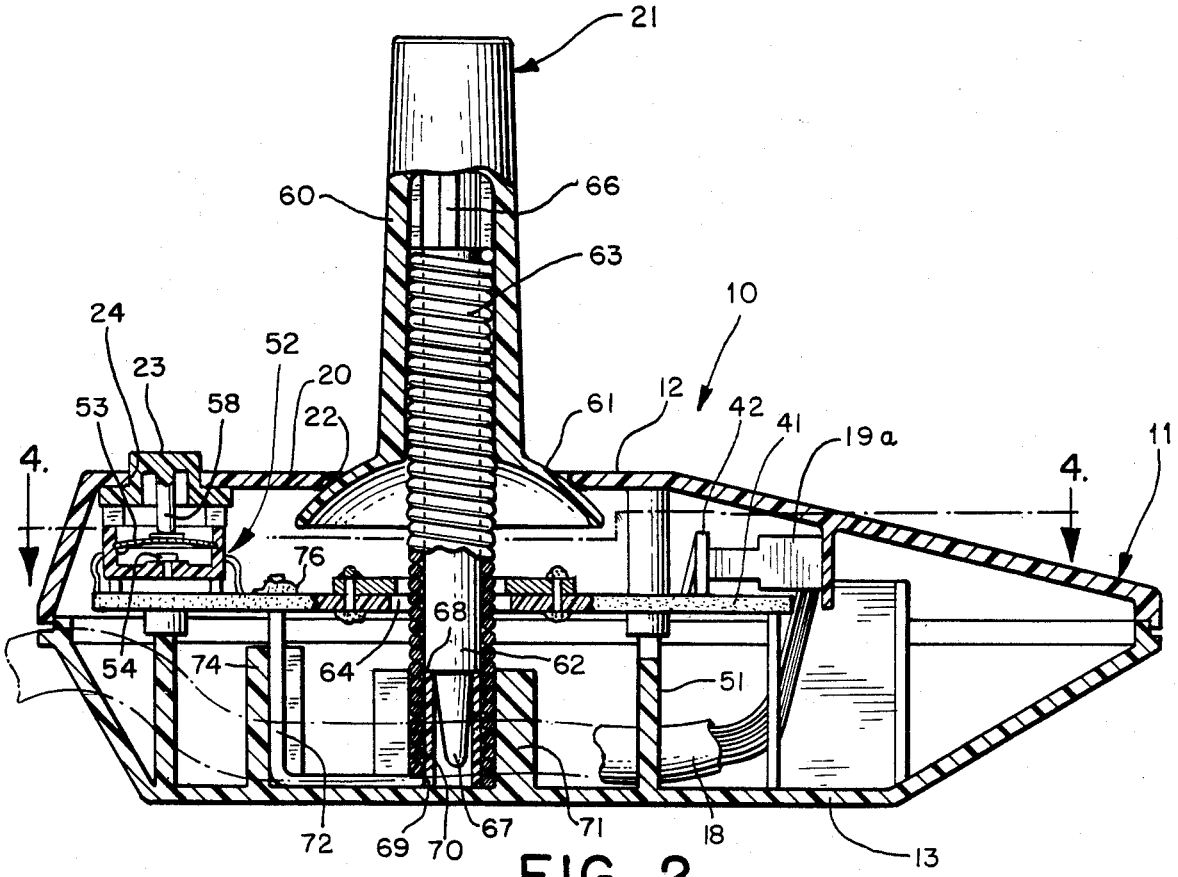
FIG. 2 is a cross-sectional view taken along line 2—2 of the hand controller illustrated in FIG. 1.
Figure 3:
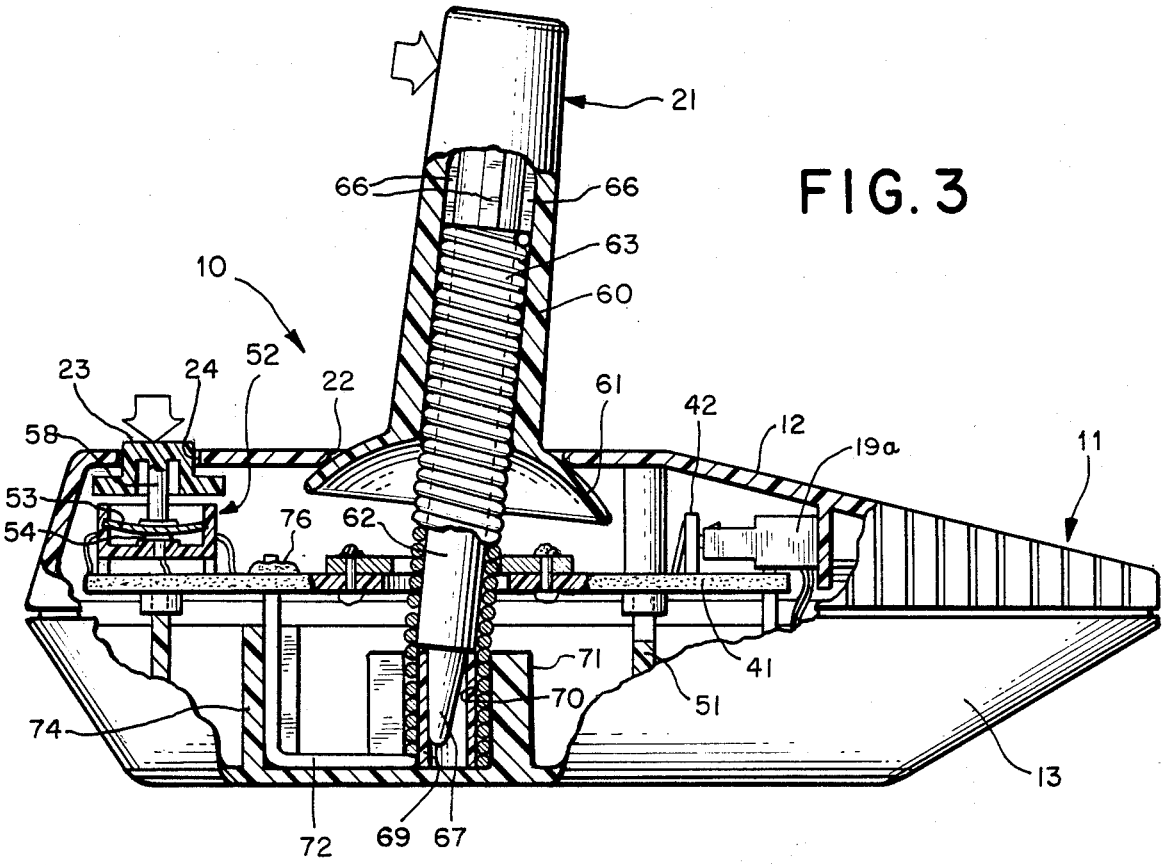
FIG. 3 is a side elevational view, partially in section, of the video game hand controller illustrated in FIG. 1 showing the control stick in a deflected position.
Figure 4:
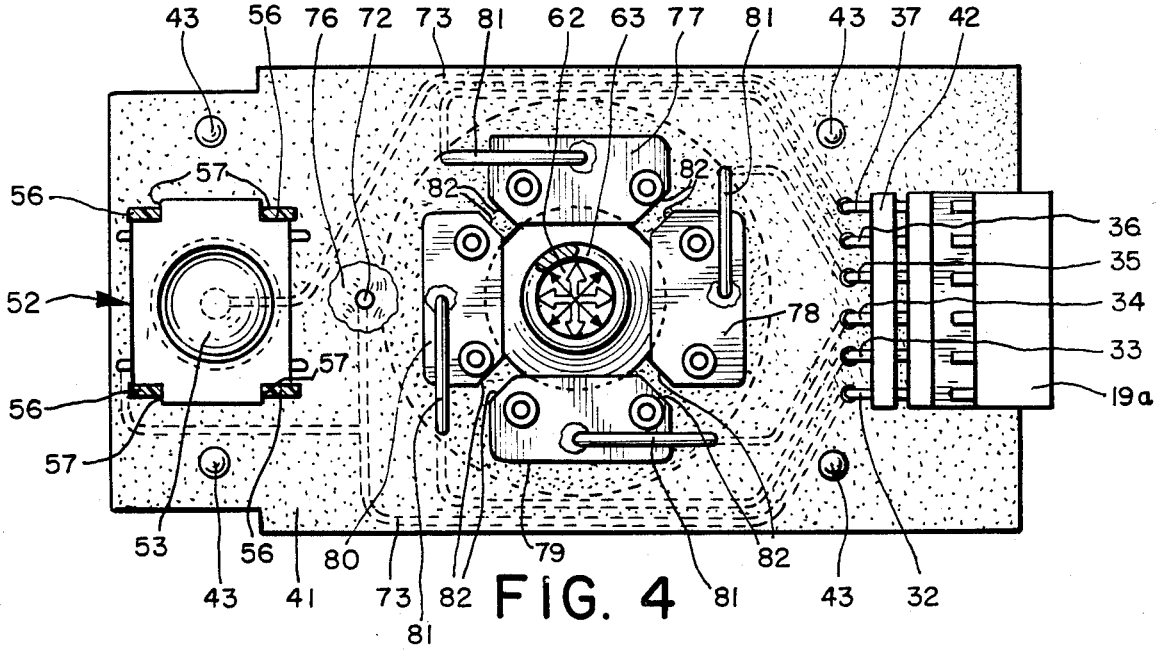
FIG. 4 is a top plan view of the printed circuit board of the hand controller illustrating the physical relationship of the helical spring to the shaped electrical contacts of the controller.

Referring to FIGS. 2–4, electrical circuitry for producing output signals appropriate to movement of the control stick is contained on a circuit board 41. The circuit board is generally rectangular in form and includes a six conductor electrical connector 42 at one end for establishing electrical contact with connector 19*a* of cable 18. The circuit board is mounted to the lower housing member 13 by means of four upwardly projecting integrally formed cylindrical mounting pins 43 (FIG. 5), which pass through apertures 47 in circuit board 41 to fix the position of the circuit board relative to the lower housing member. A plurality of cylindrical collars 50, fashioned from a deformable plastic or other appropriate material, may be placed over pins 43 to fixedly attach the circuit board to the lower housing member. Integrally formed baffles 51 extending between the pins provide mounting surfaces against which the lower surface of the circuit board rests. Complementary baffles (not shown), extending downwardly from the upper inner surface of the upper housing member, contact the upper surface of the circuit board in order to clamp the circuit board in position.

To produce an electrical output in response to downward displacement of switch actuator bar 23, an electrical dome-type switch 52 of known construction is provided at the end of circuit board 41 opposite connector 42. As best illustrated in FIGS. 2 and 3, the dome-type switch includes a disc-shaped contact 53 disposed generally horizontally over a contact 54 located centrally thereunder. These contacts are connected to conductors 32 and 37 of cable 18, respectively.

Normally, the dome switch contacts are physically separated as shown in FIG. 2 by reason of the inherent tendency of the dome contact 53 to flex upwardly. As shown in FIG. 3, an externally applied force causes the dome contact 53 to be deflected downward into contact with the lower contact 54 thereby establishing electrical continuity between the two contacts. Since conductors 32 and 37 are connected to the contacts, actuation of switch 52 results in electrical continuity between the conductors and the application of an appropriate control signal to the video game unit 10.

Actuator bar 23 is maintained in alignment relative to dome switch 52 by four downwardly-projecting integrally-formed locating tabs 56 which are received in respective locating notches 57 formed at each corner of the dome switch body to maintain the relative position of the switch actuator bar with respect to the dome switch. A downwardly projecting actuator tab 58 (FIGS. 2 and 3) located the center of the actuator bar between the four locating tabs 56 contacts the upper surface of dome contact 53. The length of each of the locating tabs 56 is such as to permit slight downward displacement of the actuator bar whereby tab 58 actuates the event switch. As previously developed, the electrical continuity thereby established is sensed by the video game unit to trigger such functions as the launching of projectiles by the video game characters.

Referring to FIGS. 2, 3 and 5, the control stick 21 is seen to include a hollow, tapered, generally cylindrical upper portion 60 and a circular lower flange portion 61. As the diameter of aperture 22 exceeds that of the control stick, the stick may be angularly displaced in a plurality of directions with respect to the upper housing member 12.

In order to translate the angular displacement of control stick 21 into an electrical response, switch means are provided responsive to such displacement. Such switch means included an elongated generally cylindrical actuator stem 62 and an electrically conductive, deformable switch contact member 63 in the form of a metallic helical coil spring 63 within which the actuator stem is coaxially received. As shown in the figures, the actuator stem 62 and coil spring 63 each pass through an aperture 64 in circuit board 41. Actuator stem 62, which may be formed from nylon or a similar durable plastic material, includes at its upper end four radially-projecting fins 66 dimensioned to the fit within hollow upper portion 60 of control stick 21. At its opposite end, actuator stem 62 includes a tapered portion 67 which forms a shoulder 68 with the main body of the actuator stem. The tapered end portion is received within a tubular sleeve 69, which also may be formed of nylon or similar durable plastic material. The sleeve 69 has an inner diameter sufficient to allow the tapered portion 67 of actuator stem 62 to be inserted therein, and an external diameter such that it is slidably received within the interior portion of helical coil spring 63.

When the hand control is fully assembled, the relative positions of control stick 21, actuator stem 62, helical coil spring 63 and sleeve 69 with respect to housing 11 are as illustrated in FIGS. 2 and 3. Referring to these figures, the coil spring 63 is seen to be slidably received within the interior of the hollow upper portion 60 of the control stick 21. The upper edge of the coil spring engages the lower edge surfaces of fins 66 to prevent further travel of the coil spring into the hollow stem. At its other end, the coil spring is received within a bore-shaped recess 70 provided in a mounting pillar 71 integrally formed in housing section 13 and is thereby fixedly positioned relative to the interior lower surface of housing member 13. Sleeve 69 is received in the interior of that portion of helical spring 63 which is contained within recess 70. The dimensions of these components are such that the spring is tightly wedged between the sleeve and the interior surface of the the recess. The coil spring mounted in this manner is capable of being deflected in all directions around its central axis, while its inherent tendency to resist deflection provides a restoring force for restoring actuator stem 62 and control stick 21 to their center non-actuated positions following such deflection. As illustrated, the tapered portion 67 of actuator stem 62 projects into the interior region of sleeve 69 so that shoulder 68 engages the upper edge of the sleeve. This engagement provides a pivot surface and prevents further downward motion of the actuator stem. Aperture 64 is of sufficient dimension as to allow the helical spring to pass therethrough without contacting circuit board 41.

At its lower end, helical spring 63 includes a projecting lead portion 72 formed as a continuation of the wire material forming the coiled portion of the spring. As shown, the lead portion 72, after passing through a notched supporting pillar 74 provided in lower housing member 13, extends through an aperture in circuit board 41 whereupon it is electrically connected to the game control circuitry by means of a soldered connection 76. In this manner, electrical communication may be established between the helical spring and the game control circuitry so that the spring itself becomes a switch contact element.

In the embodiment shown, the spring is continuously electrically connected by conventional printed wiring 73 on circuit board 41 to conductor 72 of multi-conductor cable 18, while electrical continuity is momentarily established between this conductor and conductors 33–36 according to user manipulation of the hand control. To establish such continuity, controller 10 includes four contact pads 77–80 disposed generally concentrically around helical spring 63 in a plane generally perpendicular to the central axis of the spring, as shown in FIG. 4. Each contact pad is electrically connected with one of the remaining conductors of the multi-conductor cable by respective wire leads 81 and the printed wiring 73 of the circuit board.

As shown in FIG. 4, the contact pads are generally rectangular in form and are fashioned from copper, brass or a similar electrically conductive, physically durable material. The pads are arranged in a spaced-apart generally square formation and include chamferred corners 82 which allow them to be closely positioned relative to the helical spring.

Angular displacement of control stick 21 as shown in FIG. 3 results in displacement of helical spring 63 toward a selected one or two of the contact pads. If the control stick is deflected in a cardinal direction directly toward one of the contact pads (i.e., toward direction markers 25*a*, 25*c*, 25*e* or 25*g*, of FIG. 5) the helical spring will contact one pad and establish continuity between the common conductor 32 and the conductor electrically associated with the contacted pad. However, if the control stick is directed in a non-cardinal direction (i.e., toward direction markers 25*b*, 25*d*, 25*f*, or 25*h*), the helical spring will contact the associated pair of adjacent contact pads, thereby establishing continuity between the common conductor and the two conductors associated the two contacted contact pads. Thus, it is seen that video game hand controller 10 will produce a unique electrical output in response to movement of the control stick in one of the eight cardinal and non-cardinal directions indicated by direction markers 25*a*–25*h*.

Referring to FIG. 4, the shaping and positioning of the contact pads as illustrated has the further advantage that the contact pads 77–80 define a plurality of indicies or "notches" which provide directions of preferred travel for the displaceable control stick when moved in a non-cardinal direction. In this regard, the corner formed by the adjacent edge surfaces of, for example, contact pads 79 and 80, forms a natural groove in which helical spring 63 will tend to center itself when control stick 21 is displaced in the general direction of marker 25*d* (FIG. 5). This arrangement enables the hand controller user to sense by feel when the control stick is properly positioned for a given desired movement of the video game character, and thereby adds to the overall enjoyment of the video game unit by the user.

Also contributing to the overall feel of the hand controller is the interplay of the tubular sleeve 69 and the tapered portion 67 of actuator stem 62. As will be understood most clearly by reference to FIG. 3, when control stick 21 is displaced, the tapered surface of the actuator stem contacts the interior surface of the sleeve 69. Such contact tends to limit the travel of the control stick and in turn increases the user's sense of control by creating a definite stop or limit to the travel of the control stick. A further function of sleeve 69 is to protect the actuator stem, particularly the tapered portion 67 thereof, from chafing as a result of contact with the adjacent coils of the helical spring.

While in the embodiment shown the hand controller of the invention is shown as providing electrical continuity between a common conductor and one or two of four remaining conductors in response to user displacement of a control stick, it will be appreciated that a greater or lesser number of conductors and contact pads may be provided. For example, eight suitably dimensioned contact pads may be arranged about the helical spring to provide sixteen discrete control positions. Furthermore, while the control stick 21 has been shown as a separate element from actuator stem 62, it will be appreciated that these elements can be combined, as a single element, the actuator stem then extending through aperture 22 for direct access by the user. Additionally, the event switch 23, together with its switch bar actuator, may be eliminated, or if required, additional event switches and actuator bars may be provided.

While a particular embodiment of the invention has been shown and described, it will be obvious to those skilled in the art that changes and modifications may be made therein without departing from the invention in its broader apsects, and, therefore, the aim in the appended claims is to cover all such changes and modifications as fall within the true spirit and scope of the invention.

We claim:

1. A hand operable controller for producing an electrical control signal in response to manipulation of the controller by a user comprising, a housing having an interior and a floor portion within said interior, said housing having a raised support extending upwardly from the floor portion and having a mounting pillar formed on the floor portion, said mounting pillar having a bore recess formed therein, said housing further having an aperture formed in an upper portion thereof, a mounting board positioned on the raised support of said housing, said mounting board having an aperture in a central portion thereof, at least four electrical contact pads affixed to said mounting board around the aperture in the mounting board, each of said contact pads having an edge portion extending across the aperture in the mounting board, said edge portions positioned along a rectangle overlying the aperture in the mounting board, a central contact member of electrically conductive material having a tubular shape, said central contact member forming a radial flexure and being affixed within the bore recess of the mounting pillar in the housing, and extending upwardly through the aperture in the mounting board, an actuator stem positioned within said central contact member and having a tapered portion formed on an end thereof, said tapered portion of the actuator stem being positioned inside the central contact member within the bore recess of the mounting pillar and forming a pivot for the actuator stem and associated central contact member, and a joystick member affixed to said actuator stem and extending upwardly through the opening in the upper portion of said housing, said joystick providing means for the user to flex the central contact member radially into electrical contact with the contact pads.

2. A hand operable controller as set forth in claim 1 wherein said central contact member has a projecting lead extending from an end portion affixed within the mounting pillar, said mounting pillar having a notch formed therein, said projecting lead extending through the notch in said mounting pillar.

3. A hand operable controller as set forth in claim 2 wherein said central contact member comprises a helical coil spring, said projecting lead extending from a coil of the helical spring affixed in said mounting pillar.

4. A hand operable controller as set forth in claim 1 further comprising a sleeve member positioned inside the central contact member adjacent the tapered portion of the actuator stem, said sleeve member urging the central contact member against the mounting pillar and providing a bearing surface for the tapered portion of the actuator stem.

5. A hand operable controller as set forth in claim 4 wherein said central contact member comprises a helical coil spring for engaging the electrical contact pads.

6. A hand operable controller as set forth in claim 1 wherein said central contact member comprises a helical coil spring for engaging the electrical contact pads.

7. A hand operable controller as set forth in claim 6 wherein each coil of the helical coil spring comprising the central contact member is positioned in abutting relation to adjacent coils of the spring to provide a substantially continuous contact area for electrical contact with said contact pads.

8. A hand operable controller as set forth in claim 1 further comprising a dome switch affixed on said mounting board and an elongated actuator bar positioned adjacent the dome switch, said actuator bar having a projection in the center thereof for engaging said dome switch, said actuator bar extending through a bar shaped opening in the upper portion of the housing, whereby depression of either end of the actuator bar moves the projection of the actuator bar against the dome switch to activate the switch.

9. A hand operable controller as set forth in claim 1 wherein the edge portions of each adjacent pair of contact pads form a notch corner for receiving the central contact member, said notch corner guiding the central contact member into electrical engagement with both of the contact pads in an adjacent pair of contact pads.

* * * * *

UNITED STATES PATENT AND TRADEMARK OFFICE

CERTIFICATE OF CORRECTION

PATENT NO. : 4,514,600

DATED : April 30, 1985

INVENTOR(S) : James M. Lentz

It is certified that error appears in the above-identified patent and that said Letters Patent is hereby corrected as shown below:

Title page, bracket 73, change Assignee: from "North American Philips Corporation"

to --North American Philips Consumer Electronics Corp.--.

Signed and Sealed this

*Twenty-second* Day of *October 1985*

[SEAL]

*Attest:*

DONALD J. QUIGG

*Attesting Officer*

*Commissioner of Patents and Trademarks—Designate*